United States Patent [19]

Cassens et al.

[11] 4,303,165

[45] Dec. 1, 1981

[54] CRANE WITH TELESCOPIC JIBS

[75] Inventors: Dietrich Cassens, Arfrade; Hans-Werner Dowedeit, Mollhagen, both of Fed. Rep. of Germany

[73] Assignee: O&K Orenstein & Koppel Aktiengesellschaft Werk Lübeck, Fed. Rep. of Germany

[21] Appl. No.: 973,024

[22] Filed: Dec. 26, 1978

[30] Foreign Application Priority Data

Dec. 24, 1977 [DE] Fed. Rep. of Germany ..... 2757954

[51] Int. Cl.[3] ..... B66C 23/42

[52] U.S. Cl. ..... 212/184; 52/118; 212/188

[58] Field of Search ..... 212/46 B, 46 A, 46 R, 212/54, 55, 8 R, 59 R, 144, 58 R, 58 A, 182–188, 229–232, 177, 244, 255, 264, 266, 267; 292/27, 49, 104, 30, DIG. 55, DIG. 51, DIG. 39; 52/116–120

[56] References Cited

U.S. PATENT DOCUMENTS

| | | | |
|---|---|---|---|
| 1,002,259 | 9/1911 | Goedeke | 292/104 X |
| 1,348,028 | 7/1920 | Martin | 292/49 |
| 3,366,250 | 1/1968 | Grove | 212/55 X |

FOREIGN PATENT DOCUMENTS

| | | | |
|---|---|---|---|
| 1678017 | 12/1969 | Fed. Rep. of Germany | 292/27 |
| 954 | of 1892 | United Kingdom | 292/49 |
| 463621 | 8/1975 | U.S.S.R. | 212/58 R |

*Primary Examiner*—Trygve M. Blix
*Assistant Examiner*—Edmond G. Rishell, Jr.
*Attorney, Agent, or Firm*—McGlew and Tuttle

[57] ABSTRACT

A crane comprising a ground jib, a sliding jib telescopically engaged with the ground jib and movable in a telescoping direction, and a head jib pivotally mounted to the sliding jib. A catch hook is pivotally mounted to the head jib on a pivot axis which extends in the telescoping direction of the sliding jib and a catch member is connected to the ground jib in a position to engage with the catch hook when the sliding jib is protracted into the ground jib and when the head jib is pivoted toward the ground jib. The catch member extends in the telescoping direction so that the catch hook is disengaged from the catch member when the sliding jib is extended with respect to the ground jib. A method is also disclosed for stowing the head jib of the crane.

2 Claims, 8 Drawing Figures

10
9a
8
11
7
9
12
5
6
13
4
2
1
3

CRANE WITH TELESCOPIC JIBS

BACKGROUND OF THE INVENTION

1. Field of the Invention

The invention relates to cranes in general, and particularly concerns a crane with telescopic jibs and with a head jib articulated thereon, whose one jib is provided with one or several catch hooks with abutting surfaces which keep the head jib bearing on the telescopic jib in the rest position of the crane, and which are detachable.

2. Description of the Prior Art

Cranes are known, where one or several catch hooks are generally arranged on the head jib, whose swivel axis extends transversely to the major axis of the jib. The catch hooks are kept by springs in their locking position and are provided with so-called rip cords, by which the catch hooks can be loosened. For dismantling or stowing the implements, the jibs are lifted close to their vertical positions. The head jib, which is articulated on the front end of the ground jib for rotation about a horizontal axis, swings and finally opens the catch hooks when bearing on the ground jib, which then snap in and keep the head jib bearing on the ground jib. For rigging or erecting the crane, the rip cord is pulled, so that it or the catch hooks release the movement of the head jib and they can be brought into the head position. In this design, the two jib parts must always be brought into the same position with respect to each other during the above described dismantling, so that the catch hooks are in the correct position relative to the opposite pieces or catch members on the other jib part.

A crane with telescopic jibs is also known where the locking mechanisms consists of projections and counterparts arranged on the head jib and on the ground jib, and on the other hand, release each other during the extension.

To this end, tongues provided with slots are arranged on the head jib, and on the other hand, projections are provided on the ground jib. Care must be taken that, when the extensible jib portion of the head jib and the ground jib are in a certain position to each other during the retraction; the projections are in the proper position with respect to the slots in the following displacement of the two jibs. This requires auxiliary means. These consist, on the one hand of a cable guide for the hoisting cable arranged on the ground jib. The hoisting cable is first looped around this cable guide. Furthermore the hoisting cable must be anchored on the supporting frame of the jib on which the hoisting cable can be secured by an operator with the head jib lowered, after it has been looped around the cable guide. The hoisting cable of the head jib, laid and anchored this way, can then be pulled to the ground jib. Then the insertable end of the ground jib is retracted. A guide is provided for the engagement of the locking means, which is arranged between the ground jibs and the head jib, and which ensures the necessary proper position of the two jib parts to each other. This guide consists of a guide rod on the ground jib, which engages the groove of the cable pulley at the front end of the head jib in the rest position of the latter (U.S. Pat. No. 3,366,250).

SUMMARY OF THE INVENTION

This invention is based on the problem of designing a crane of the above described type so that its construction and its operation are simplified, particularly the engagement and disengagement of the catch hooks. The invention consists in that the swivel axis of the catch hooks and the counterparts of the catch hooks extend in the telescoping direction of the jibs. The invention has the advantage that the two jib parts need not be brought into a certain position for locking the head jib on the ground jib, seen in the longitudinal direction. The dismantling is therefore faster and simpler than heretofore.

The counterpart(s) or catch members can be designed in various ways. A simple design consists in that the counterparts of the catch hooks have an angular profile. These angle pieces extend in certain regions in the direction of the jibs.

In order to facilitate the disengagement of the jib parts from each other, the jib carrying the counterparts or catch members of the catch hooks, can be provided with an expanding device according to another feature of the invention, which presses the catch hooks against each other or out of the locking positions during the displacement of the jibs.

A very simple embodiment of the invention consists in that the angular counterpart is so arranged that it is in the range of the catch hook(s) when the sliding jib is completely retracted. For dismantling, it suffices to bring the sliding jib into the completely retracted position and then to luff it up so high that it swings, and the head jib finally snaps into the catch position. For rigging, however, it suffices to extend the sliding parts somewhat, with the ground jib upright, so that the catch hook slides along the angular counterpart up to its end. The catch hook and thus the head jib ae released. In order to facilitate the dismantling, the two jibs can be provided with interlocking guide pieces, which bring the jibs into a certain position to each other in the bearing position. A simple embodiment consists in that the counterparts to the catch hooks form at the same time the guide pieces or parts thereof. For fastening the head jib bearing on the ground jib, the guide pieces can be joined with each other in the rest position of the two jibs by detachable locking means-like known bolts.

A. Accordingly an object of the present invention is to provide a crane comprising, a ground jib, a sliding jib telescopally engaged with said ground jib and movable in a telescoping direction, a head jib pivotally mounted to said sliding jib, at least one catch hook pivotally mounted to one of said ground and head jibs, and a catch member connected to the other of said ground and head jibs and engagable with said catch hook when said head jib is pivoted towards said ground jib and extending along said telescoping direction.

A further object of the present invention is to provide a method for stowing a crane having a ground jib with a sliding jib telescopically engaged to the ground jib and a head jib pivotally mounted to the sliding jib comprising, providing at least one catch hook which is pivotally mounted to one of the head and ground jibs, providing a catch member extending in the direction of telescoping of the sliding jib on the other of the head and ground jibs, retracting the sliding jib with respect to the ground jib to bring the at least one catch hook and the at least one catch member in alignment with each other, and moving the ground jib to swing the head jib and bring the catch hook into engagement with the catch member.

A further object of the present invention is to provide a crane which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
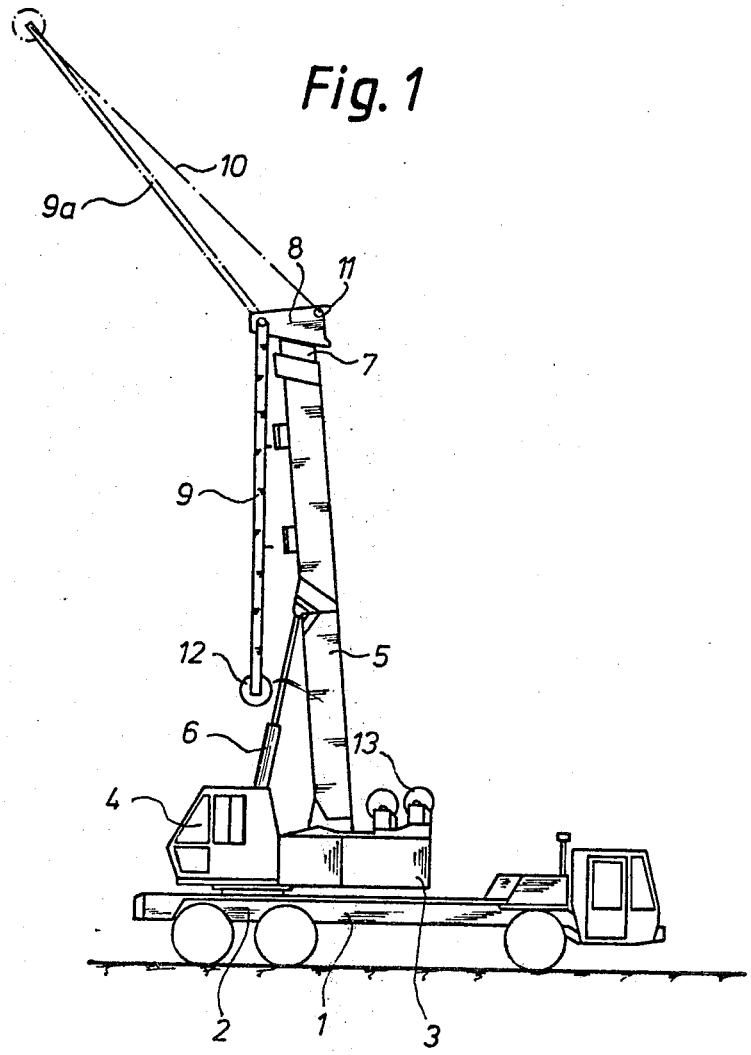
FIG. 1 is a side elevational view of a mobile crane with a ground jib luffed up in two different operating positions.

Turning to the drawings in particular, the invention embodied therein, in FIG. 1 comprises a crane having a ground jib 5 with a sliding jib 7 telescopically engaged therewith and a head jib 9 pivotally mounted to the sliding jib 7.

The embodiment shows a crane 1 with a supporting frame 3 swivelable about a vertical axis 2, which contains the driver's cab 4 and the ground jib 5 which is swivelable in a vertical plane. Two luffing cylinders 6 are provided for luffing the ground jib up and down.

On ground jib 5 are arranged sliding jibs, the last of which 7 carries a head 8 on which head jib 9 is articulated. The latter is shown in FIG. 1 in broken lines in its assembled or erected position **9*a*, in which it is held by a bracing cable 10 which is secured on the rear end 11 of head 8**. Other types of fastening for the head jib are also possible.

Head jib 9 carries at its front end a cable pulley 12. The hoisting cable (not shown) runs over this cable pulley and a cable pulley, likewise not shown, in head 8 to hoisting cable winch 13.

The position of the jibs in FIG. 1 is that assumed during dismantling or stowing of the jibs. Ground jib 5 has then its steepest position of about 85°. Sliding jib 7 is retracted so that head 8 is in its retracted end position. Head jib 9 then hangs down perpendicularly.

Figure 2:
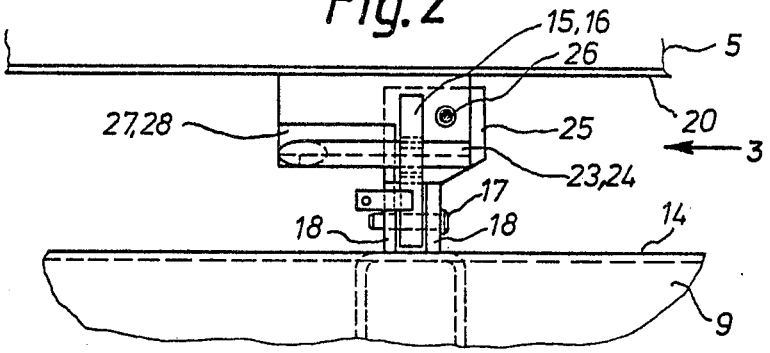
FIG. 2 is a view taken along line 2—2 of FIG. 8.
Figure 3:
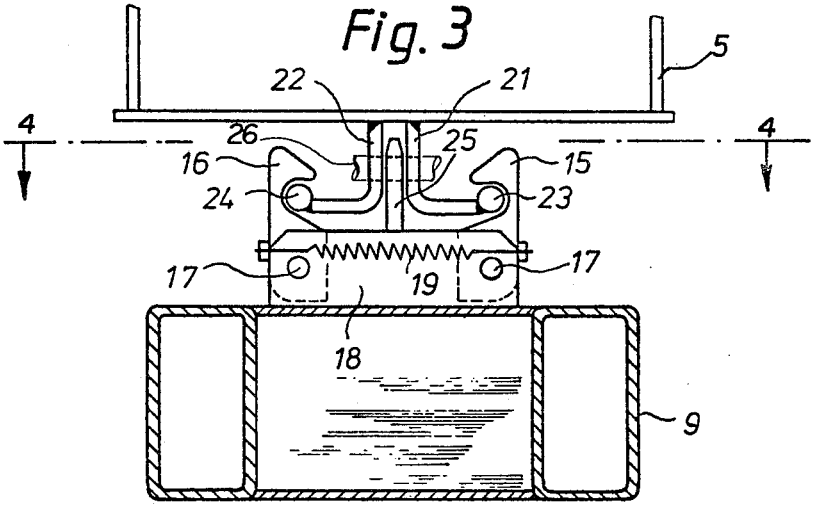
FIG. 3 is a side view of FIG. 2 taken in the direction arrow 3.
Figure 4:
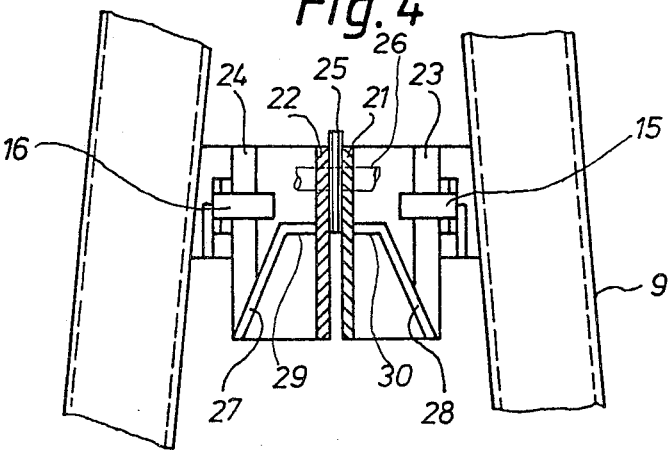
FIG. 4 is a view taken along line 4—4 of FIG. 3.

As seen in FIGS. 2, 3 and 4, on the underside 14 of head jib 9 are secured in the rear area of a block 18, the two catch hooks 15 and 16 which are pivotally mounted about swivel axis 17, which are pulled a biased toward each other by a tension spring 19. In the area of catch hooks 15, 16, with sliding jib 7 completely retracted, are secured angular counterparts 21, 22 on the underside 20 of ground jib 5. On the free edges of counterparts 21, 22 are secured round irons or catch members 23, 24. These bear form-locking on catch hooks 15, 16 in the locking position. On block 18 is secured a guide piece 25 which engages, in the locking position, in to the interval between counterparts 21, 22. In the represented locking position, these parts are secured against each other by a lock bolt 26. On the bottom end of ground jib 5 are furthermore secured two conically tapered expanding plates 27, 28, which are covered at their front end 29,30 and welded on counterparts 21,22.

Figure 5:
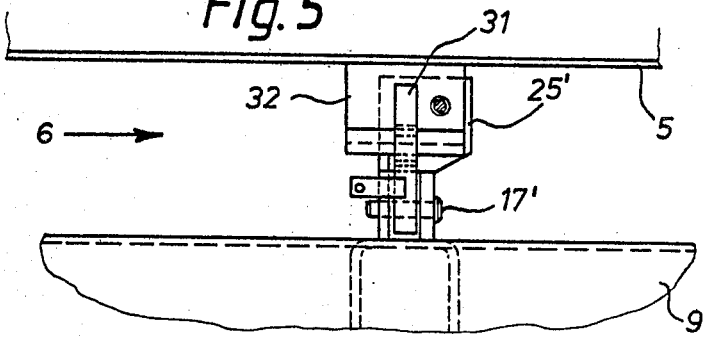
FIG. 5 is a figure taken along line 5—5 of FIG. 8; showing another embodiment of a portion of the invention.
Figure 6:
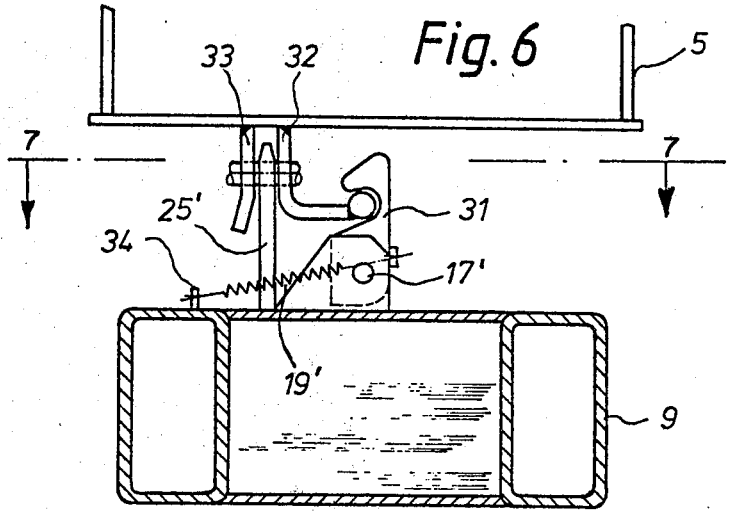
FIG. 6 is a view taken in the direction of arrow 6 of FIG. 5.
Figure 7:
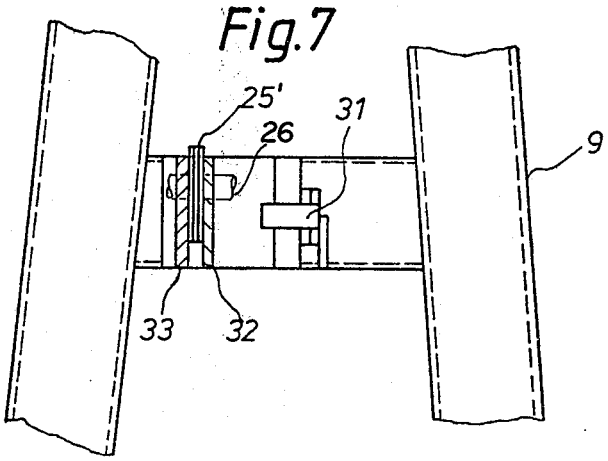
FIG. 7 is a figure taken along line 7—7 of FIG. 6.

The embodiment in sectional plane 5—5 according to FIGS. 5 to 7 differs from the above described embodiment substantially in that only one catch hook 31 is pivotally mounted about axis 17' on head jib 9, which engages counterpart or catch member 32. Instead of the second counterpart according to FIG. 3, only one guide piece 33 is secured on ground jib 5 which act with piece 25'. Tension spring 19 acts at 34 on head jib 9. The expanding device is omitted in FIGS. 5, 6, 7 in order to simplify the representation.

Figure 8:
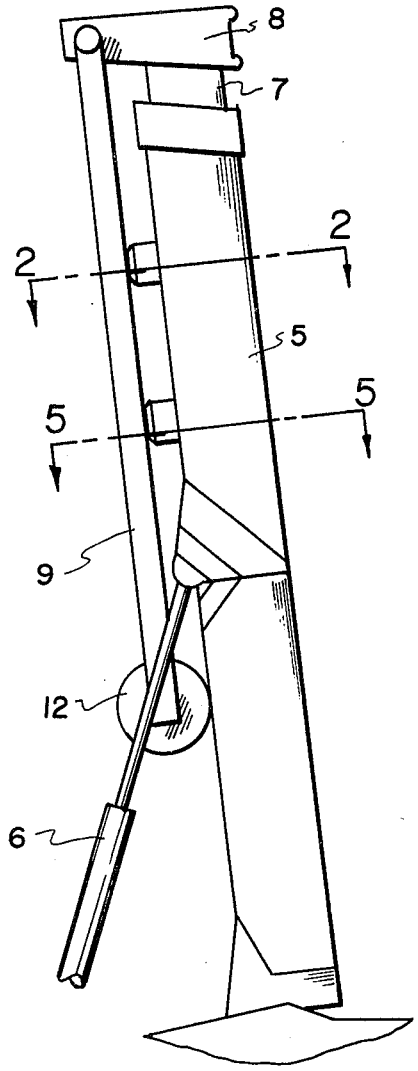
FIG. 8 is a partial view similar to FIG. 1 showing the head jib in its locked positions.

Toward the end of the dismantling operation, when bracing cable 10 has been detached from head jib **9*a*, with the jib lowered, ground jib 5 is brought into the position shown in FIG. 1 on the left side in solid lines. The ground jib has its steepest position, head jib 9 hangs down. Ground jib 5 is now luffed up and down, so that head jib 9 swings and finally bears on ground jib 5—as shown in FIG. 8-having pressed catch hooks 15, 16 into place over their abutting surfaces. Catch hooks 15,16,31 now engage counterparts 21,22, 32. Later, with ground jib 5 lowered, lock bolt 26** is inserted.

When head jib 9 bears on ground jib 5, guide plate 25 engages the interval between counterparts 21,22.

During the rigging of the crane, ground jib is brought into the position shown in FIG. 8. Sliding jib 7 and head 8 are now pushed up, and expanding plates 27,28 push catch hooks 15,16 out of their locking position and release the head jib so that it can swivel into the position shown in FIG. 1.

The expanding plates 27,28 according to FIGS. 2–4 can also be omitted according to another feature of the invention. During the rigging it is then necessary to displace the two jibs so far toward each other by retraction that catch hooks 15,16 finally slide off the free ends of round irons 23,24. Head jib 9 is then released and swings into the position shown in FIG. 1.

We claim:

1. A crane comprising, a ground jib, a sliding jib telescopically engaged with said ground jib and movable in a telescopic direction between a fully retracted position and an extended position, a head jib pivotally mounted to said sliding jib, at least one catch hook pivotally mounted to said head jib, a catch member connected to said ground jib engageable with said catch hook when said head jib is pivoted toward said ground jib with said sliding jib in the fully retracted position, said catch member and a pivotal axis of said catch hook extending along said telescopic direction of said sliding jib, said catch member comprising an angular profile portion extending from said ground jib a spring connected to said catch hook for biasing said catch hook into a position of engagement between said catch hook and said catch member, said angular profile piece having a tapered extending plate for engagement with said catch hook when said sliding jib is extended from said ground jib to disengage said catch hook from said catch member, a first guide piece connected to said head jib, a second guide piece connected to said ground jib and spaced from said angular profile piece for receiving said first guide piece between said second guide piece and said angular profile portion for aligning said catch hook with said catch member when said catch hook and catch member are engaged, and a bolt detachably connected between said angular profile portion and first first and second guide pieces when said catch hook is engaged with said catch member for locking said head jib to said ground jib.

2. A crane comprising a ground jib, a sliding jib telescopically engaged with said ground jib and movable therein in a telescoping direction, a head jib pivotally mounted to an outer end of said sliding jib, a pair of catch hooks pivotally mounted to said head jib on axes extending parallel to said telescoping direction, a biasing spring extending between said patch of catch hooks biasing them together, a pair of angled profiled portions connected to said ground jib having ends extending in opposite directions and including catch members extending paralllel to said telescoping direction on each of said ends of said angled profile portions, said catch members being aligned with said catch hooks when said sliding jib is retracted into said ground jib whereby said head jib is pivotable toward said ground jib with said sliding jib retracted to bring said catch hooks into engagement with said catch members, said pair of angled profile portions having tapered extending plates for engagement with said catch hooks when said sliding jib is extended from said ground jib to disengage said catch hooks from said catch members, an interlocking guide piece connected to said head jib extending outwardly therefrom between said pair of catch hooks, said pair of angular profile portions sapced from each other, said interlocking guide piece being movable between said angled profile portions when said catch hooks are engaged with said catch members to align said catch hooks with said catch members, and a bolt connected through aligned openings in said angled profile portion and said interconnecting guide piece when said catch hooks are engaged with said catch members.

* * * * *